United States Patent [19]

Fearnley et al.

[11] 4,115,294

[45] Sep. 19, 1978

[54] BACTERICIDAL SOAP BAR

[75] Inventors: Charles Fearnley, Romiley; Glenda Helen Fordham, Glossop; Frank Lee, Bolton, all of England

[73] Assignee: Ciba-Geigy Corporation, Ardsley, N.Y.

[21] Appl. No.: 757,805

[22] Filed: Jan. 7, 1977

[30] Foreign Application Priority Data

Jan. 10, 1976 [GB] United Kingdom ..... 940/76
Feb. 24, 1976 [GB] United Kingdom ..... 7153/76

[51] Int. Cl.[2] ..... C11D 9/50

[52] U.S. Cl. ..... 252/106; 424/320; 424/340; 424/347

[58] Field of Search ..... 252/106, 107, 546, 117, 252/403; 260/404; 424/317, 320, 340

[56] References Cited

U.S. PATENT DOCUMENTS

| | | | |
|---|---|---|---|
| 3,074,980 | 1/1963 | Lorentzen | 260/404 |
| 3,085,066 | 4/1963 | Mitoray et al. | 252/107 |
| 3,284,362 | 11/1966 | Zussman | 252/107 |
| 3,323,884 | 6/1967 | Thompson et al. | 44/66 |
| 3,445,398 | 5/1969 | Jungermann et al. | 252/107 |
| 3,544,606 | 12/1970 | Singer | 260/404 |
| 3,625,903 | 12/1971 | Davies et al. | 252/107 |
| 3,723,326 | 3/1973 | Cheng et al. | 252/107 |
| 3,787,227 | 1/1974 | Marans | 106/14 X |
| 3,969,259 | 7/1976 | Lages | 252/107 |

FOREIGN PATENT DOCUMENTS 882,635 11/1961 United Kingdom.

*Primary Examiner*—P.E. Willis, Jr.
*Attorney, Agent, or Firm*—Edward McC. Roberts; Prabodh I. Almaula

[57] ABSTRACT

Bactericidal soap bar containing in combination a bactericidal compound of the formula

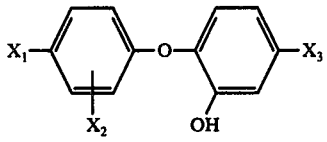

(I)

wherein each of $X_1$ and $X_3$ independently represents a halogen atom which is the same or different and $X_2$ represents a hydrogen or halogen atom, and a compound of the formula $$R-CO-\underset{\underset{CH_3}{|}}{N}-CH_2COOH \quad \text{(II)}$$

wherein R represents an alkyl or alkenyl group of 8 to 17 carbon atoms.

5 Claims, No Drawings

BACTERICIDAL SOAP BAR

The present invention provides bactericidal soap bars. It is known to use halogenated phenols as bactericidal compounds. Many such phenol compounds, for example halogenated o-hydroxy-diphenyl ethers, have the disadvantage that they discolour the soap bars in which they are incorporated if the soap bars are exposed to sunlight. To overcome this disadvantage, it has been proposed in U.S. Pat. No. 3,248,362 to incorporate carboxylic acids as light stabilisers, but no improvement in the process of manufacture or of the quality of the soap is achieved.

British Patent Specification No. 1,175,408 describes the use of free straight-chain fatty acids in a concentration of 1 to 15 percent by weight. These fatty acids, which are known as superfatting agents, are effective light stabilisers for bactericidal soap bars and improve the quality thereof.

It has now been found that bactericidal soap bars can be protected against the action of light by incorporating N-acylsarcosine derivatives.

The soap bars of the present invention containing up to 3 percent by weight, referred to the total weight of the soap bar, of a bactericidal compound of the formula

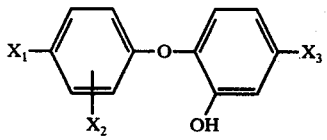

(I)

wherein each of $X_1$ and $X_3$ independently represents a halogen atom which is the same or different and $X_2$ represents a hydrogen or halogen atom, contains a further 0.1 to 10 percent by weight, referred to the total weight of the soap bar, of a compound of the formula $$R-CO-\underset{\underset{CH_3}{|}}{N}-CH_2COOH \qquad (II)$$

wherein R represents an alkyl or alkenyl group of 8 to 17 carbon atoms.

Possible halogen atoms are fluorine, chlorine, bromine and iodine atoms, and are preferably chlorine and bromine atoms.

The soap bar of the present invention contains in general 0.1 to 3, preferably 0.2 to 2, percent by weight, referred to the total weight of the soap bar, of a compound of the formula (I).

Examples of suitable bactericidal compounds of the formula (I) are:

3',4,4'-trichloro-2-hydroxydiphenyl ether, 4,4'-dichloro-2-hydroxydiphenyl ether, 4-chloro-4'-bromo-2-hydroxydiphenyl ether, 4-chloro-4'-iodo-2-hydroxydiphenyl ether, 4-chloro-4'-fluoro-2-hydroxydiphenyl ether, 4-bromo-4'-chloro-2-hydroxydiphenyl ether, 4-bromo-2',4'-dichloro-2-hydroxydiphenyl ether, 4,4'-dibromo-2-hydroxydiphenyl ether and, in particular, 2',4,4'-trichloro-2-hydroxydiphenyl ether.

The antimicrobial compounds of the formula (I) can also be used in conjunction with other antimicrobial compounds, such as halogenated hydroxydiphenylmethanes, halogenated salicylanilides, halogenated diphenylureas, such as trichlorocarbanilide, tribromosalicylanilide, dibromosalicylanilide, and the zinc salt of 1-hydroxy-2-pyridinthione.

Examples of compounds of the formula (II) are lauroylsarcosine, cocoylsarcosine and oleoylsarcosine, wherein the amount of unsaturated constituent in cocoylsarcosine can be up to 11 percent by weight.

Soap bars of the present invention contain preferably 0.1 to 5 percent by weight, referred to the total weight of the soap bar, of the compound of the formula (II).

In a preferred embodiment, the soap bar of the present invention contains in addition 0.05 to 0.99 percent by weight, referred to the total weight of the soap bar, of a substantially straight-chain fatty acid containing 8 to 22 carbon atoms. Examples of such fatty acids are: capric acid, lauric acid, myristic acid, palmitic acid, stearic acid, arachidic acid, sebacic acid, dodecanedioic acid, tetradecanedioic acid, hexadecanedioic acid and octadecanedioic acid, and mixtures of acids derived from coconut oil, tallow fat or palm kernel oil.

The ratio of compound of the formula (I) to compound of the formula (II) in the soap bars of the invention is for example 20:1 to 1:2, preferably 2:1 to 1:2. The total amount of the compounds of the formulae (I) and (II) in the soap bars is preferably at least 1.5 percent by weight, referred to the total weight of the soap bar.

The soap bars of the present invention are obtained by homogeneously premixing a soap base with a compound of the formula (I) and a compound of the formula (II).

Preferably a white milled soap is used as soap base, for example a refined grade obtained from tallow fat, coconut oil and sperm oil.

The soap bars can be obtained by the dry mix process, but to achieve a maximum lightfastness the compound of the formulae (I) and (II) are preferably dissolved beforehand in an organic solvent and added to the dry soap base.

The bactericidal soap bars of the present invention possess a good lightfastness and good surfactant and foam-stability properties.

The invention is illustrated by the following Example, in which the parts are by weight.

EXAMPLE

Soap bars are prepared by mixing 1 or 2 parts of 2',4,4'-trichloro-2-hydroxydiphenyl ether, 0.5, 1 or 2 parts of oleoylsarcosine and 0.2 part of titanium dioxide with soap chips to 100 parts. After being ground twice, these bars are pressed into small balls.

A number of these balls are exposed to direct sunlight for 4 hours and tested for their discolouration. The results are reported in the following table.

TABLE

| Test | 2,4,4'-trichloro-2'-hydroxydiphenyl ether parts | oleoyl-sarcosine parts | Exposed to the sun | Visual evaluation |
|---|---|---|---|---|
| 1 | 1.0 | 0 | yes | strong discolouration |
| 2 | 1.0 | 0.5 | yes | strong reduction in the discolouration |

TABLE-continued

| Test | 2,4,4'-trichloro-2'-hydroxydiphenyl ether parts | oleoyl-sarcosine parts | Exposed to the sun | Visual evaluation |
|---|---|---|---|---|
| 3 | 1.0 | 1.0 | yes | very strong reduction in the discolouration |
| 4 | 2.0 | 0.1 | yes | strong reduction in the discolouration |
| 5 | 2.0 | 0.5 | yes | strong reduction in the discolouration |
| 6 | 2.0 | 1.0 | yes | strong reduction in the discolouration |
| 7 | 2.0 | 2.0 | yes | strong reduction in the discolouration |

Similar results are obtained by using lauroylsarcosine instead of oleoylsarcosine.

We claim:

1. A bactericidal soap bar consisting essentially of (a) 0.1 to 3 percent by weight, based on the total weight of the soap bar, of a bactericidal compound of the formula

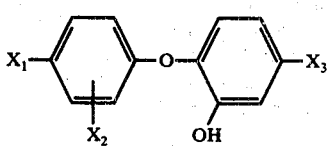

(I)

wherein each of $X_1$ and $X_3$ independently represents a halogen atom which is the same or different and $X_2$ represents a hydrogen or halogen atom, and (b) 0.1 to 10 percent by weight, based on the total weight of the soap bar, of a compound of the formula $$R-CO-\underset{\underset{CH_3}{|}}{N}-CH_2COOH \qquad (II)$$

wherein R represents an alkyl or alkenyl group of 8 to 17 carbon atoms.

2. A bactericidal soap bar according to claim 1, which contains 0.1 to 5 percent by weight of a compound of the formula (II).

3. A bactericidal soap bar according to claim 2, which contains 0.2 to 2 percent by weight of a compound of the formula (I).

4. A bactericidal soap bar according to claim 3, which contains 2',4,4'-trichloro-2-hydroxydiphenyl ether as compound of the formula (I).

5. A bactericidal soap bar according to claim 4, which contains oleoylsarcosine as compound of the formula (II).

* * * * *